US005335400A

United States Patent [19]

Sales

[11] Patent Number: 5,335,400

[45] Date of Patent: Aug. 9, 1994

[54] DRAWSTRING PULLER AND FASTENER FOR SHOELACES

[76] Inventor: Buenaventura Z. Sales, P.O. Box 9154, San Jose, Calif. 95157

[21] Appl. No.: 959,123

[22] Filed: Oct. 9, 1992

[51] Int. Cl.[5] ..... A43C 7/00

[52] U.S. Cl. ..... 24/712.5

[58] Field of Search ..... 24/712.1, 712.5, 715.4, 24/30.5 R, 30.5 L, 136 L, 136 R, 715.6

[56] References Cited

U.S. PATENT DOCUMENTS

| | | | |
|---|---|---|---|
| 515,155 | 2/1894 | Nelson . | |
| 2,443,335 | 6/1948 | Vogel . | |
| 3,845,575 | 11/1974 | Boden . | |
| 3,965,544 | 6/1976 | Boden . | |
| 4,112,551 | 9/1978 | Sales . | |
| 4,665,590 | 5/1987 | Udelhofen et al. | 24/712.5 X |
| 4,680,835 | 7/1987 | Horng | 24/712.5 |
| 4,782,560 | 11/1988 | Keller | 24/136 L |

FOREIGN PATENT DOCUMENTS

| | | |
|---|---|---|
| 59008 | 5/1918 | Austria . |
| 723716 | 8/1942 | Fed. Rep. of Germany . |
| 1171802 | 6/1964 | Fed. Rep. of Germany . |
| 80351 | 3/1963 | France . |
| 572449 | 1/1958 | Italy . |
| 34651 | 3/1910 | Sweden . |
| 883050 | 11/1961 | United Kingdom . |
| 886566 | 1/1962 | United Kingdom . |
| 1515107 | 6/1978 | United Kingdom . |

*Primary Examiner*—James R. Brittain
*Attorney, Agent, or Firm*—Jack M. Wiseman

[57] ABSTRACT

A drawstring puller and fastener that laces separable members of a shoe or the like. The free ends of a shoelace pass through openings formed in a hollow, bell-shaped socket and are formed with a knot disposed in an axial opening of the tapered plug. The axial opening is formed with an oval cross-sectional area. The plug draws the shoelace for the tightening of the shoelace lacing the separable members. While the plug draws the shoelace for the tightening of the shoelace, the knot engages the inner wall of the plug surrounding the axial opening at the oval cross-sectional area. While the shoelace is tightened by the pulling of the plug, the socket is in abutment with the separable members. While the loop of the shoelace extending from the socket is held taut, the plug, which is formed with ridges on the outer wall, is inserted and press fitted into the socket wedging securely the shoelace therebetween. The inner wall of the socket is free of ridges to enable the ridged plug to enter the socket freely. The openings formed in the socket through which the free ends of the shoelace pass are located adjacent to the closed top of the socket for maintaining the socket flat against the separable members while obviating the tendency of the socket to rise upwardly from the top members.

9 Claims, 1 Drawing Sheet

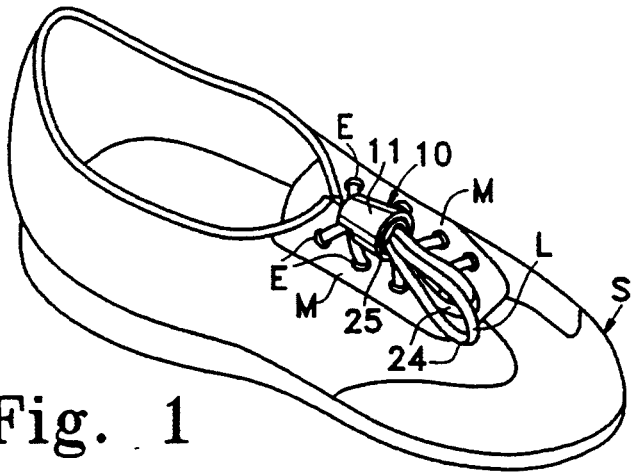
Fig. 1
Fig. 5
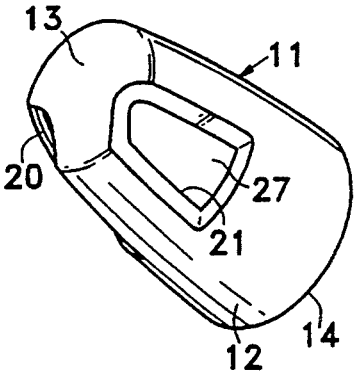
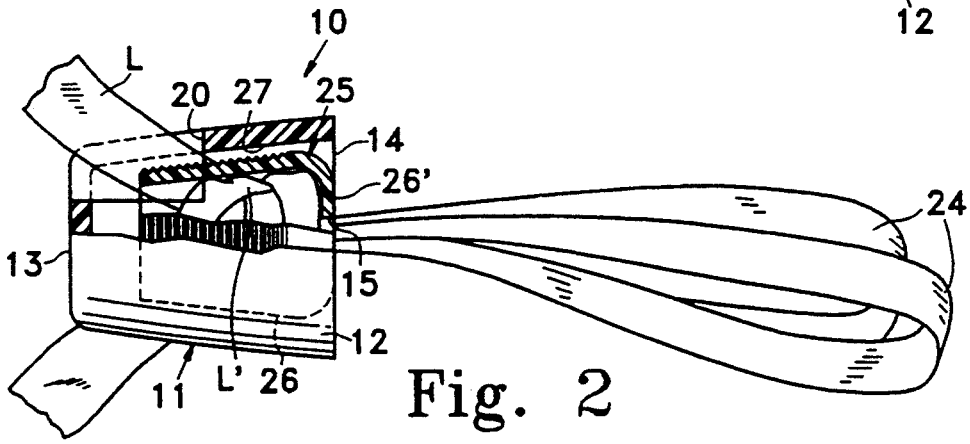
Fig. 2
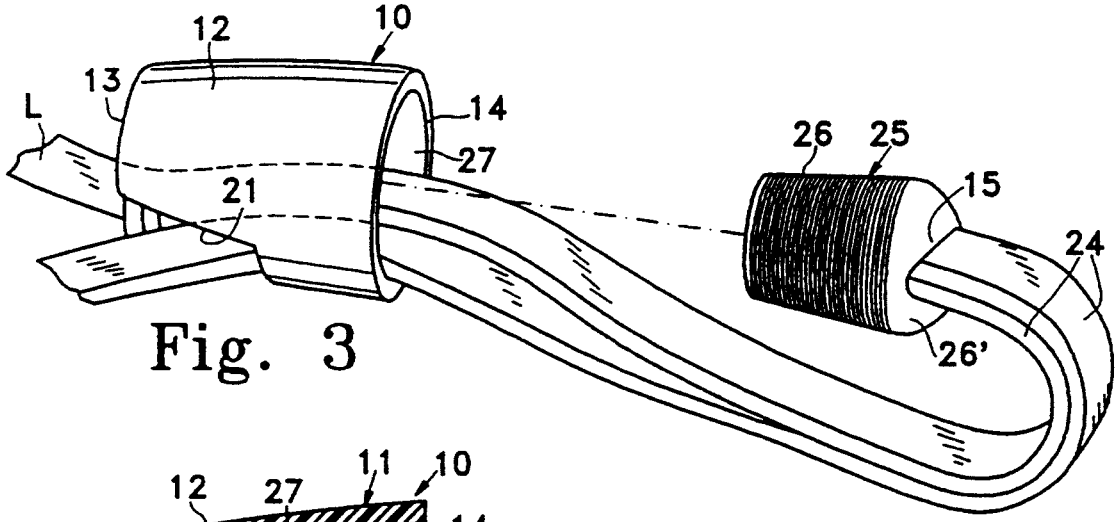
Fig. 3
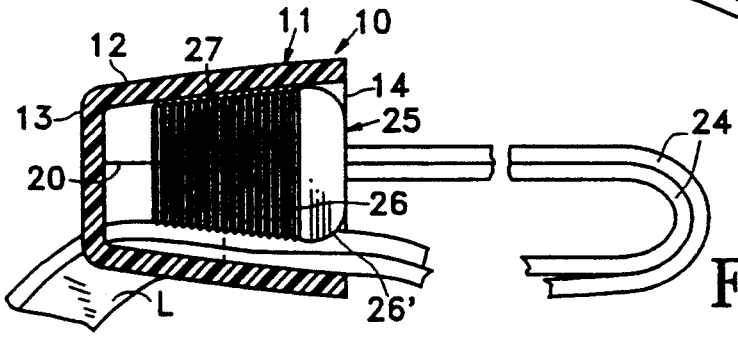
Fig. 4

DRAWSTRING PULLER AND FASTENER FOR SHOELACES

BACKGROUND OF THE INVENTION

The present invention relates in general to fasteners for shoelaces, and more particularly to a drawstring puller and fastener for shoelaces.

Heretofore, drawstring pullers and fasteners employed a socket with a ridged inner wall. As a consequence thereof, the ridged inner all of the socket interfered with the insertion of the drawstring plug into the socket for the wedging of the drawstring therebetween. Additionally, cylindrical openings were formed in the upper section of the socket for receiving the drawstring for the wedging of the drawstring between the drawstring plug and the socket for the securement of the drawstring. The cylindrical openings formed in the socket were located near the closed upper end of the socket. As a result thereof, the socket had a tendency to rise away from the separable top members of the shoe instead of lying flat against the separable top members of the shoe.

The U.S. Pat. to Sales, No. 4,112,551 issued on Sep. 12, 1978, for Draw String Puller And Fastener discloses a drawstring pull plug with a ridged outer wall and a socket with an interlocking ridged inner wall. The drawstring is wedged between the plug and the socket for the taut securement of the drawstring in interlacing engagement with the separable top members of a shoe.

In the U.S. Pat. to Nelson, No. 515,155, issued on Feb. 20, 1894, for Automatic Tyer For Bags, there is disclosed a socket having openings through which ends of a cord pass. A locking block is attached to one end of the cord. The one end of the cord is drawn into the socket by tension on the other end of the cord. The locking block binds the free end of the cord in the socket. Both the interior wall of the socket and the exterior wall of the locking block are smooth.

In the U.S. Pat. to Boden, No. 3,845,575, issued on Nov. 5, 1974, for Cord Locking Assembly discloses a fastener body which receives the free ends of a lace. A locking element enters the body to tighten the free ends of the lace between the fastener body and the locking element. The free ends of the lace extending from the locking elements form two loops.

In the U.S. Pat. to Boden, No. 3,965,544, issued on Jun. 29, 1976, for Locking Device With Combined Wedging And Spring Action discloses a locking device for a shoelace. The free ends of the shoelace are received by a body. A locking slide enters the body to wedge the free ends of the shoelace therebetween. Arms on the slide provide a spring action to clamp the free ends of the lace between the body and the slide.

In the U.S. Pat. to Vogel, No. 2,443,335, issued on Jun. 15, 1948, for Fastening Device discloses a cover through which pass the ends of a cord. The cord is also received at its free ends by a tapered base. The cover is hollow and the insertion of the base into the cover wedges the ends of the cords between the cover and the base.

SUMMARY OF THE INVENTION

A drawstring puller and fastener comprises a drawstring that interlacingly engages separable members. The free ends of the drawstring pass through openings formed in a socket and are secured to a plug in the vicinity of the free ends of the drawstring. The plug is employed to draw the drawstring for the tightening of the drawstring engaging the separable members. While the drawstring is tightened by the pulling of the plug, the socket is in abutment with the separable members. While the loop of the drawstring extending from the socket is held taut, the plug, which is formed with exteriorly projecting ridges, is inserted and press fitted into the socket wedging securely the drawstring therebetween. The inner wall of the socket is smooth to enable the ridged confronting wall of the plug to enter the socket freely, while tension is applied to the loop of the drawstring, for wedging the drawstring therebetween for the taut securement of the drawstring in interlacing engagement with the separable members.

A drawstring puller and fastener comprises a drawstring that interlacingly engages separable members. The free ends of the drawstring pass through openings formed in the socket and are secured to the plug in the vicinity of the free ends of the drawstring. The plug is used to draw the drawstring for the tightening of the drawstring engaging the separable members. While the drawstring is tightened by the pulling of the plug, the socket is in abutment with the separable members. While the loop of the drawstring extending from the socket is held taut, the plug is inserted and press fitted into the socket wedging securely the drawstring therebetween. The openings formed in the socket through which the free ends of the drawstring pass are located adjacent to the closed top of the socket and extend midway between the open bottom of the socket and the closed end of the socket, for maintaining the socket flat against the separable members and obviating the tendency of the socket to rise upwardly from the top members.

An object of the present invention is to provide a drawstring puller and fastener in which a drawstring puller plug having exteriorly projecting ridges is insertable and press fitted into a socket without interference, while wedging a drawstring therebetween for the taut securement of the drawstring in interlacing engagement with separable members.

Another object of the present invention is to provide a drawstring puller and fastener in which a drawstring puller plug is insertable and press fitted into a socket for the wedging of a drawstring therebetween for the taut securement of the drawstring in interlacing engagement with separable members while maintaining the socket flat against the separable members and obviating the tendency of the socket to rise upwardly from the separable members.

Another feature of the present invention is the provision of an axial opening formed in a plug of the drawstring puller and fastener for preventing a knot formed from a lace with a relatively small cross-sectional area from slipping out of the plug, while accommodating a knot formed from a lace with a relatively large cross-sectional area.

DESCRIPTION OF THE DRAWINGS

FIG. 1 is a perspective view of the drawstring puller and fastener for shoelaces embodying the present invention and illustrated with a shoe to show the shoelace maintained in the taut condition for tight interlacing engagement with the separable top members of a shoe.

FIG. 2 is an enlarged plan view of the drawstring puller and fastener shown in FIG. 1 and partially broken away to illustrate the socket and plug thereof wedging the shoelace therebetween.

FIG. 3 is an exploded view of the drawstring puller and fastener shown in FIG. 2.

FIG. 4 is an axial sectional view of the drawstring puller and fastener shown in FIG. 2.

FIG. 5 is a perspective view of the socket for the drawstring puller and fastener shown in FIG. 2.

DESCRIPTION OF THE PREFERRED EMBODIMENT

Illustrated in FIGS. 1–4 is a drawstring puller and fastener 10 embodying the present invention for securely fastening a shoelace L in order to maintain the shoelace L in a tightened condition for interlacing securely the separable members M of a shoe S or the like. While reference is made to a shoelace, it is apparent that other forms of drawstrings may be employed equally as well. The drawstring puller and fastener comprises a rigid hollow, bell-shaped socket 11 with a gradually expanding frustoconical sidewall 12 from the closed top 13 thereof to an open bottom 14 thereof. In the exemplary embodiment, the socket 11 is made of a rigid plastic. The sidewall 12 of the socket 11 has angularly spaced openings 20 and 21 formed adjacent to the closed top 13 of the socket 11 to receive the respective ends of the shoelace L. By placing the openings 20 and 21 adjacent to the closed top 13 of the socket 11 to extend midway between the opened bottom 14 of the socket 11 and the closed top 13 of the socket 11, the socket 11 maintains a flat abutting engagement with the separable top members M of the shoe S and obviates the tendency of the socket 11 from rising upwardly from the top members M of the shoe S (FIG. 1) while the shoelace L is under tension for interlacing securely the separable members M.

The shoelace L interlacingly engages the eyelets E or other suitable drawstring engaging or receiving means formed in the separable members M of the shoe S for maintaining the separable members M in contiguous or adjacent relation while the shoelace L is tightened. The ends of the shoelace L extend from the upper pair of eyelets E of the separable members M into the openings 20 and 21, respectively, formed in the socket 11. The ends of the shoelace L continue therefrom and extend through the opened bottom 14 of the socket 11 and enter an axial opening 15 of a tapered drawstring puller plug 25 adjacent the widest extent of the tapered wall 26 of the plug 25. The free ends of the shoelace L, in the preferred embodiment, are in the form of a knot L′ disposed in the axial opening 15 of the plug 25. The free ends of the shoelace L are tied into a knot so that the plug 25 serves as a knob by which the free ends of the shoelace L can be pulled to tighten the interlacing engagement between the shoelace L and the top members M of the shoe S. Toward this end, the knot L′ engages the inner wall of the curved end 26′ of the plug 25 surrounding the axial opening 15. In the exemplary embodiment, the plug 25 is made of a rigid plastic material.

The axial opening 15 at the curved end 26′ of the plug 25 has an oval configuration in cross-sectional area. Thus, the narrow section of the cross-sectional area of the axial opening 15 at the curved end 26′ of the plug 25 inhibits or prevents the knot L′ of a lace L relatively small in cross-sectional area from slipping out of the plug 25, while the knot L′ of a lace L relatively large in cross-sectional area is accommodated by the wider section of the cross-sectional area of the axial opening 15 at the curved end 26′ of the plug 25.

During the tightening and fastening of the shoelace L, the socket 11 is held flat against the uppermost ends of the top members M (FIG. 1). While the socket 11 is held flat against the uppermost ends of the separable top members M of the shoe S by one hand, the shoelace L is pulled taut by gripping the plug 25 with the other hand and pulling the drawstring plug 25 away from the socket 11. The shoelace L is held under tension by the other hand and loops 24 are formed in the shoelace L. Thereupon, the narrow end of the tapered plug 25 is inserted and press fitted into the socket 11. The shoelace L is thereby wedged between the outer wall of the plug 25 and the inner wall of the socket 11. While the narrow end of the tapered plug 25 is inserted into the socket 11 for wedging the shoelace L therebetween, the shoelace L is maintained taut for the separable members M to be maintained contiguous or adjacent one another. After the narrow end of the tapered plug 25 is press fitted into the socket 11, the loops 24 are present between the wide end of the plug 25 and the opening 14 of the socket 11.

The tapered outer wall 26 of the plug 25 is formed with ridges or annular ridges, and the confronting inner wall 27 of the socket 12 is smooth through the omission of projections or ridges therealong to enable the threaded tapered outer wall 26 to be inserted and press fitted into the socket 11 without inteference from ridges, projections or the like. The annular ridges on the wall 26 of the tapered plug 25 provide an improved wedging action, and a non-slip fit for the wedging of the shoelace L between the socket 12 and the plug 25. When the plug 25 is fully inserted into the socket 25, the shoelace L is securely fastened therebetween in order to maintain the shoelace L in a tightened condition for interlacing securely the separable members M of the shoe S.

For releasing the tension on the shoelace L for the separation of the separable members M of the shoe S, the plug 25 is merely removed from the socket 11. There is now sufficient play in the shoelace L for the separating of the separable members M.

What is claimed is:

1. A drawstring puller and fastener for separable members having drawstring engaging means, said drawstring puller and fastener comprising:

(a) a drawstring received by said drawstring engaging means to draw said separable members toward one another, said drawstring having free ends;

(b) a hollow socket with a closed end from which a frustoconical hollow wall has a taper widening toward an open end, apertures formed in said frustoconical wall through which pass the free ends of said drawstring, the free ends of said drawstring continue therefrom to pass through the open end of said hollow socket, said frustoconical wall having a smooth inner surface without projections; and (c) a tapered drawstring pull plug having a wide end and a narrow end, said plug having an axial opening at the wide end thereof for receiving the free ends of said drawstring which have passed through said open end of said hollow socket, the free ends of said drawstring received by said plug being disposed within said axial opening, said plug at its narrow end being inserted into said open end of said socket and press fitted into and directly with said socket after said drawstring has been tightened and while said drawstring remains taut for wedging said drawstring between said frustoconical wall of said socket and said plug to interlace securely the separable members, said plug having an outer wall formed with ridges to provide a non-slip fit for the wedging of the drawstring between said socket and said plug, said plug having a smooth entry into said socket without interference from said socket except to provide a direct press fit therebetween.

2. A drawstring puller and fastener as claimed in claim 1 wherein said apertures formed in said frustoconical wall are located contiguous to the closed end of said socket and sharing a common edge therewith for disposing and maintaining said socket flat against the separable members and obviating the tendency of said socket to rise upwardly from the separable members.

3. A drawstring puller and fastener as claimed to claim 2 wherein said free ends of said drawstring between the wide end of said plug and the open end of said socket are in the form of loops.

4. A drawstring puller and fastener as claimed in claim 2 wherein said apertures formed in said frustoconical wall and located contiguous to the closed end of said socket extend substantially midway between said open end of said socket and said closed end of said socket.

5. A drawstring puller and fastener as claimed in claim 1 wherein said free ends of said drawstring extending between the wide end of said plug and the open end of said socket are in the form of loops.

6. A drawstring puller and fastener as claimed in claim 1 wherein said axial opening of said plug is formed with an oval cross-sectional area, said free ends of said drawstring being formed with a knot disposed in engagement with an inner wall of said plug adjacent said oval cross-sectional area of said axial opening.

7. A drawstring puller and fastener for separable members having drawstring engaging means, said drawstring puller and fastener comprising:

(a) a drawstring received by said drawstring engaging means to draw said separable members toward one another, said drawstring having free ends;

(b) a hollow socket with a closed end from which a frustoconical hollow wall has a taper widening toward an open end, apertures formed in said frustoconical wall through which pass the free ends of said drawstring, the free ends of said drawstring continue therefrom to pass through the open end of said hollow socket; and (c) a tapered drawstring pull plug having a wide end and a narrow end, said plug having an axial opening at the wide end thereof for receiving the free ends of said drawstring which have passed through said open end of said socket, the free ends of said drawstring received by said plug being disposed within said axial opening, said plug at its narrow end being inserted into the open end of said socket and press fitted into said socket after said drawstring has been tightened and while said frustoconical wall of said socket and said plug to interlace securely the separable members, said plug having an outer wall formed with ridges to provide a non-slip fit for the wedging of said drawstring between said socket and said plug, (d) said apertures formed in said socket being located contiguous to the closed end of said socket and sharing a common edge therewith for disposing and maintaining said socket flat against the separable members and for obviating the tendency of said socket to rise upwardly from the separable members.

8. A drawstring puller and fastener as claimed in claim 7 wherein said free ends of said drawstring extending between the wide end of said plug and the open end of said socket are in the form of loops.

9. A drawstring puller and fastener as claimed in claim 7 wherein said apertures formed in said frustoconical wall and located contiguous to the closed end of said socket extend substantially midway between said open end of said socket and said closed end of said socket.

* * * * *